US012788154B2

(12) United States Patent
Pearson et al.

(10) Patent No.: US 12,788,154 B2
(45) Date of Patent: Nov. 10, 2026

(54) MATTRESSES WITH STABILIZED UPPER SURFACES

(71) Applicant: Purple Innovation, LLC, Lehi, UT (US)

(72) Inventors: Brett Pearson, Taylorsville, UT (US); Robert W. Taylor, Highland, UT (US)

(73) Assignee: Purple Innovation, LLC, Draper, UT (US)

( * ) Notice: Subject to any disclaimer, the term of this patent is extended or adjusted under 35 U.S.C. 154(b) by 99 days.

(21) Appl. No.: 18/420,544

(22) Filed: Jan. 23, 2024

(65) Prior Publication Data

US 2024/0245225 A1 Jul. 25, 2024

Related U.S. Application Data

(60) Provisional application No. 63/440,591, filed on Jan. 23, 2023.

(51) Int. Cl.

| | |
|---|---|
| ***A47C 27/045*** | (2006.01) |
| ***A47C 27/05*** | (2006.01) |
| ***A47C 27/06*** | (2006.01) |

(52) U.S. Cl.

CPC ..... *A47C 27/0456* (2013.01); *A47C 27/05* (2013.01); *A47C 27/066* (2013.01); *A47C 27/045* (2013.01)

(58) Field of Classification Search

CPC ... A47C 27/0456; A47C 27/045; A47C 27/05; A47C 27/066

USPC ..... 5/721–723, 739

See application file for complete search history.

(56) References Cited

U.S. PATENT DOCUMENTS

| | | | | |
|---|---|---|---|---|
| 2,326,441 | A | 8/1943 | Cunningham | |
| 3,283,345 | A | 11/1966 | Berck | |
| 5,953,778 | A * | 9/1999 | Hiatt | A47C 27/001 5/722 |
| 6,088,857 | A * | 7/2000 | Ogle | A47C 27/002 5/722 |
| 6,772,463 | B2 * | 8/2004 | Gladney | A47C 27/04 5/717 |
| 7,200,884 | B2 * | 4/2007 | Wright | A47C 27/001 5/717 |
| 7,219,381 | B2 * | 5/2007 | Damewood | A47C 27/001 5/717 |

(Continued)

FOREIGN PATENT DOCUMENTS

| | | | | |
|---|---|---|---|---|
| WO | WO-2024158828 A1 * | 8/2024 | ..... | A47C 27/085 |

OTHER PUBLICATIONS

United States Patent and Trademark Office acting as International Searching Authority, "International Search Report and Written Opinion," International Application No. PCT/US2024/012639, May 6, 2024.

*Primary Examiner* — Robert G Santos
(74) *Attorney, Agent, or Firm* — Foley & Lardner LLP

(57) ABSTRACT

A mattress assembly with a surface that is stabilized to prevent separation of rails (e.g., side rails, end rails) from edges of a primary cushion of the mattress assembly. A strip of scrim fabric may overlap each rail and an adjacent portion of the primary cushion to stabilize the interface or seam between an edge of the primary cushion and a rail positioned against that edge. Methods for stabilizing the upper surfaces of mattress assemblies are also disclosed, as are adjustable beds including mattresses with stabilized upper surfaces.

16 Claims, 2 Drawing Sheets

(56) References Cited

U.S. PATENT DOCUMENTS

| | | | | |
|---|---|---|---|---|
| 7,424,762 | B2 * | 9/2008 | Wright | A47C 27/063 5/717 |
| 7,574,763 | B2 * | 8/2009 | Gladney | A47C 27/14 5/717 |
| 8,001,639 | B2 * | 8/2011 | Gladney | A47C 27/148 5/717 |
| 11,793,324 | B2 * | 10/2023 | Long | A47C 27/056 |
| 12,303,035 | B2 * | 5/2025 | Anderson | A47C 27/056 |
| 2002/0151243 | A1 | 10/2002 | Flick et al. | |
| 2003/0177585 | A1 * | 9/2003 | Gladney | A47C 27/14 5/717 |
| 2005/0005364 | A1 * | 1/2005 | Gladney | A47C 27/14 5/727 |
| 2005/0081298 | A1 * | 4/2005 | Wright | A47C 27/063 5/690 |
| 2007/0186350 | A1 * | 8/2007 | Wright | A47C 27/063 5/690 |
| 2007/0220681 | A1 * | 9/2007 | Gladney | A47C 23/00 5/717 |
| 2010/0175197 | A1 * | 7/2010 | Gladney | A47C 27/066 5/739 |
| 2020/0015597 | A1 | 1/2020 | Guy et al. | |
| 2022/0296002 | A1 | 9/2022 | Long | |
| 2022/0296003 | A1 | 9/2022 | Whatcott et al. | |
| 2023/0110050 | A1 * | 4/2023 | Anderson | A47C 27/06 5/690 |
| 2024/0245225 | A1 * | 7/2024 | Pearson | A47C 27/05 |

* cited by examiner

MATTRESSES WITH STABILIZED UPPER SURFACES

CROSS-REFERENCE TO RELATED APPLICATION

A claim for priority to the Jan. 23, 2023 filing date of U.S. Provisional Patent Application No. 63/440,591, titled MATTRESSES WITH STABILIZED UPPER SURFACES ("the '591 Provisional Application") is hereby made pursuant to 35 U.S.C. § 119(e). The entire disclosure of the '591 Provisional Application is hereby incorporated herein.

TECHNICAL FIELD

This disclosure relates generally to mattresses and, more specifically, to mattresses with surfaces that are stabilized to prevent separation of side rails of a mattress from side edges of a primary cushion of the mattress. Even more specifically, this disclosure relates to mattresses with upper surfaces that are stabilized with scrims positioned over boundaries between the side rails and sides of the primary cushion of the mattress. Methods for stabilizing the upper surfaces of mattresses are also disclosed, as are adjustable beds including mattresses with stabilized upper surfaces.

RELATED ART

Purple Innovation manufactures mattresses that include primary cushions surrounded by rails, including side rails and end rails. The primary cushions of such mattresses include interconnected walls that define an array of cells, or hollow columns. The interconnected walls are formed from a dense gel material, which may settle, sag, or "fall" when a primary cushion is not peripherally confined. The rails of such mattresses are typically formed from a polyurethane foam with sufficient rigidity to define the outer periphery of the mattress and, when held in place with adhesive materials and a cover of the mattress, peripherally confine the primary cushion when the mattress is placed on a flat surface to prevent the primary cushion of the mattress from settling, sagging, or falling.

When a mattress is placed on an adjustable platform and the adjustable platform is moved to impart the mattress with a certain contour, or shape, portions of the mattress may not completely settle into concavely angled joints between adjacent sections of the adjustable platform. While the side rails of the mattress may remain elevated over concavely angled joints in the adjustable platform, the denser gel of the primary cushion of the mattress may fall into the concavely angled joints, which may cause the primary cushion of the mattress to separate from the side rails, which may induce premature wear in the mattress.

SUMMARY

In one aspect, a mattress with a stabilized surface is disclosed. Such a mattress includes a primary cushion adjacent to its top surface and rails at least partially surrounding the primary cushion. The primary cushion may be formed from a material with a density that exceeds a density of the rails. In some embodiments, the primary cushion may comprise interconnected walls that define a plurality of cells. Each cell and the walls that define it may together define a hollow column, which may comprise a buckling column. The interconnected walls may be formed as a grid that defines an array of cells.

An embodiment of a mattress assembly with a stabilized surface includes a primary cushion, side rails, and strips of scrim fabric. The mattress assembly may also include end rails.

The primary cushion includes an upper surface and a lower surface opposite from the upper surface. The primary cushion also includes a periphery including a first end edge (e.g. a head edge, etc.), a second end edge (a foot edge, etc.), and side edges. In some embodiments, the primary cushion may comprise an elastomeric gel. The elastomeric gel may define interconnected walls that define a plurality of cells. Each cell and the walls that define it may together define a hollow column, which may comprise a buckling column. The interconnected walls may be formed as a grid that defines an array of cells.

Each side rail may include an upper surface and a lower surface. In addition, each side rail may include an outer edge and an inner edge, as well as ends. The inner edge of each side rail may be positioned adjacent to a side edge of the primary cushion. The upper surface of the side rail may be substantially flush with or substantially coplanar with an upper surface of the primary cushion. The side rail may comprise a compressible, resilient foam material. A stiffness or firmness of the material that forms the side rail may exceed a stiffness or firmness of the material that forms the primary cushion.

In embodiments where the mattress assembly includes end rails, each end rail may include an upper surface and a lower surface, an outer edge, an inner edge, and ends. The inner edge of each end rail may be positioned adjacent to an end edge of the primary cushion. The upper surface of the end rail may be substantially flush with or substantially coplanar with an upper surface of the primary cushion. The end rail may comprise a compressible, resilient foam material. A stiffness or firmness of the material that forms the end rail may exceed a stiffness or firmness of the material that forms the primary cushion.

Each strip of scrim fabric may comprise a material that may receive (e.g., engage, be impregnated with, etc.) an adhesive material (e.g., a glue), a material that forms the primary cushion, or the like. In some embodiments, the scrim fabric may comprise cotton, such as a blend of cotton with a synthetic material (e.g., a cotton spandex blend, etc.). The scrim fabric may be woven or non-woven.

Each strip of scrim fabric may include an outer side edge, an inner side edge, and ends. A strip of scrim fabric may be positioned over the interface, or seam, between each side rail and a side portion of the upper surface of the primary cushion adjacent to the side rail, as well as over at least portions of the upper surface of the side rail and the side portion of the upper surface of the primary cushion. The outer side edge of the strip of scrim fabric may be positioned over or adjacent to an outer edge of the side rail. The inner side edge of the strip of scrim fabric may be positioned over the side portion of the upper surface of the primary cushion. In some embodiments, the inner side edge of the strip of scrim fabric is located about 2 inches to about 6 inches interior to the side edge of the primary cushion. A central portion of the upper surface of the primary cushion may remain exposed beyond the strip of scrim fabric.

In embodiments where the mattress assembly also includes one or more end rails, at least part of an end portion of each strip of scrim fabric that extends over a side rail may be positioned over a portion of the upper surface of an end rail. In addition, another strip of scrim fabric may be positioned over an interface or seam between the end rail and the end edge of the primary cushion, as well as over portions of upper surfaces of the end rail and the primary cushion that are adjacent to that interface. Optionally, the ends of such a strip of scrim fabric may be positioned over parts of the end portions of the side rails of the mattress assembly.

Each strip of scrim fabric may be secured directly or indirectly (e.g., through an overlapping portion of another strip of scrim fabric, etc.) to the portions of the upper surfaces the side rail and/or end rail(s) it overlies and to a portion of the upper surface of the primary cushion it overlies. Without limitation, each strip of scrim fabric may be glued or otherwise adhesively secured to the portions of the upper surfaces of the side rail and/or end rail(s) it overlies. Each strip of scrim fabric may be directly or indirectly (e.g., through an overlapping portion of another strip of scrim fabric, etc.) to the portion of the upper surface of the primary cushion it overlies with an adhesive material, such as a glue, or by being bonded (e.g., melt bonded, in which the elastomeric material of the primary cushion may wick into or impregnate the strip of scrim fabric; etc.) by a material of the upper surface of the primary cushion that engages (e.g., has impregnated, etc.) the strip of scrim fabric.

In another aspect, a method for assembling a mattress includes positioning a strip of scrim fabric over an interface between a side edge of a primary cushion and a side rail adjacent to the side edge of the primary cushion and over portions of the upper surfaces of the side rail and primary cushion adjacent to the interface. The method also includes securing the strip of scrim fabric to the upper surface of the side rail and securing the strip of scrim fabric to the upper surface of the primary cushion.

In situations where the mattress assembly includes one or more end rails, a strip of scrim fabric may also be positioned over an interface between an end edge (e.g., a head edge, a foot edge, etc.) of the primary cushion and the end rail adjacent to the end edge of the primary cushion, as well as over portions of the upper surfaces of end rail and primary cushion adjacent to the interface. The strip of scrim fabric may be secured to the upper surface of the end rail and the upper surface of the primary cushion.

In some embodiments, the primary cushion may comprise an elastomeric gel. The elastomeric gel may define interconnected walls that define a plurality of cells. Each cell and the walls that define it may together define a hollow column, which may comprise a buckling column. The interconnected walls may be formed as a grid that defines an array of cells.

Each side rail and/or end rail may include an upper surface and a lower surface. In addition, each side rail may include an outer edge and an inner edge, as well as ends. The inner edge of each side rail and/or end rail may be positioned adjacent to a corresponding edge (e.g., a side edge, an end edge, etc.) of the primary cushion. The upper surface of each side rail and/or end rail may be substantially flush with or substantially coplanar with an upper surface of the primary cushion. Each side rail and/or end rail may comprise a compressible, resilient foam material. A stiffness or firmness of the material that forms the side rail and/or end rail may exceed a stiffness or firmness of the material that forms the primary cushion.

Positioning of the strip of scrim fabric may include positioning an exterior lateral side of the strip of scrim fabric over or adjacent to an outer edge of the side rail and positioning an interior lateral side of the strip of scrim fabric over the side portion of the primary cushion. Positioning the strip of scrim fabric may comprise leaving a central portion of the elastomeric cushioning element exposed beyond the strip of scrim fabric. Positioning the strip of scrim fabric may comprise positioning the interior lateral side of the strip of scrim fabric about 2 inches to about 6 inches interior to the side edge of the elastomeric cushioning element.

In embodiments where the mattress assembly includes side rails and at least one end rail adjacent to at least one end of the primary cushion, positioning a strip of scrim fabric along the side rail may include positioning at least one end portion of the strip of scrim fabric at over a portion of the at least one end rail and/or positioning a strip of scrim fabric along the end rail may include positioning end portions of the strip of scrim fabric over portions of the side rails.

Securing the strip of scrim fabric to the portion(s) of the upper surface(s) of the side rail(s) and/or end rail(s) the strip of scrim fabric overlies may comprise directly or indirectly (e.g., through an overlapping portion of another strip of scrim fabric, etc.) to the portion(s) of the upper surface(s) of the side rail(s) and/or end rail(s) the strip of scrim fabric overlies. The strip of scrim fabric may be secured to that (those) portion(s) of the upper surface(s) of the side rail(s) and/or end rail(s) it overlies with an adhesive material, such as a glue.

Securing the strip of scrim fabric to the portion of the upper surface of the primary cushion it overlies may comprise directly or indirectly (e.g., through an overlapping portion of another strip of scrim fabric, etc.) to the portion of the upper surface of the primary cushion it overlies. The strip of scrim fabric may be secured to that portion of the upper surface of the primary cushioning with an adhesive material, such as a glue. Alternatively, the strip of scrim fabric may be bonded to the upper surface of the primary cushion. In embodiments, where a material at the upper surface of the primary cushion may reflow when heated (i.e., the material is thermoplastic) (e.g., in embodiments where the primary cushion comprises an elastomeric gel, etc.) the strip of scrim fabric may be melt bonded to the upper surface of the primary cushion. The strip of scrim fabric may be melt bonded to the upper surface of the primary cushion by heating the upper surface of the elastomeric cushioning element (e.g., through the scrim fabric, etc.) to a temperature that causes elastomeric material at the upper surface of the elastomeric cushioning element to melt and wick into or impregnate the strip of scrim fabric.

In some embodiments, the strip of scrim fabric may be concurrently secured to the upper surfaces of the side rail/end rail and the primary cushion. In embodiments where the mattress assembly includes a plurality of strips of scrim fabric, two or more strips of scrim fabric (e.g., strips of scrim fabric over side rails and side portions of the primary cushion, etc.) may be simultaneously secured to the side rails/end rails and/or to the primary cushion.

Other aspects of the disclosed subject matter, as well as features and advantages of various aspects of the disclosed subject matter, should become apparent to those of ordinary skill in the art through consideration of the preceding disclosure, the accompanying images, and the appended claims.

DETAILED DESCRIPTION

Figure 1:
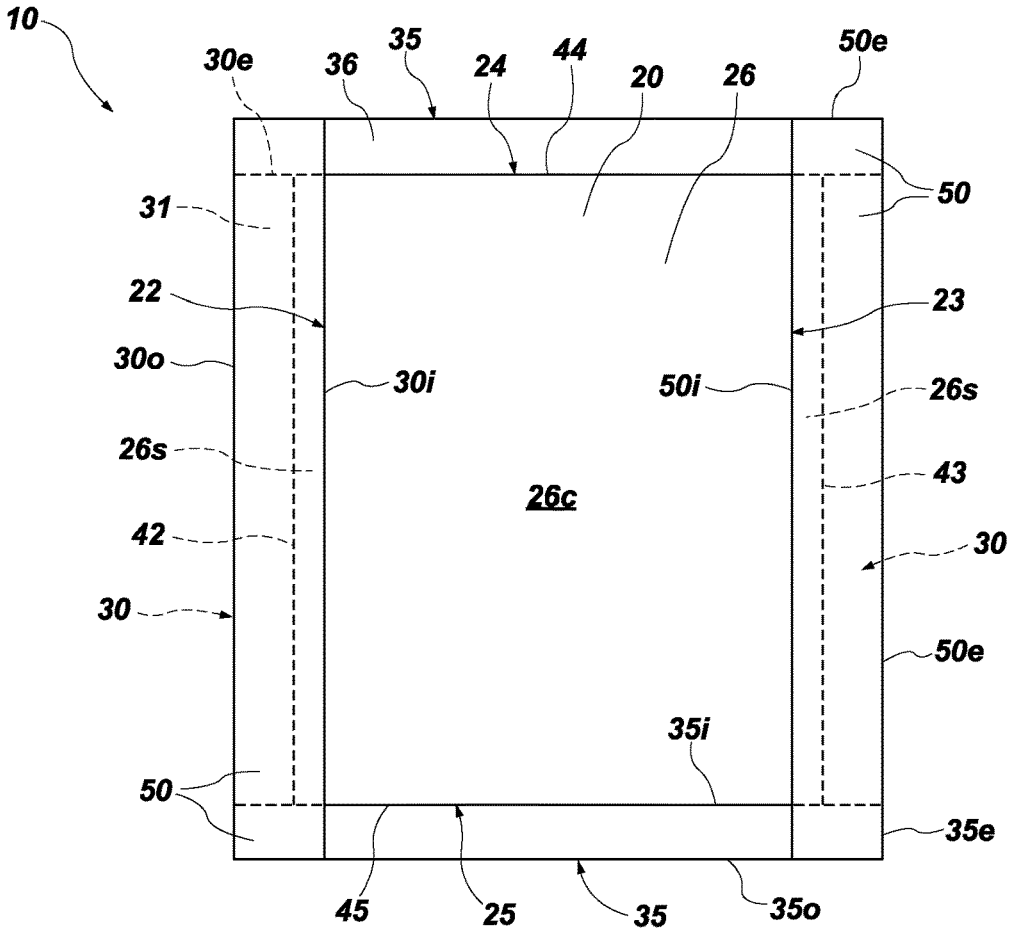
FIG. 1 is a schematic representation of an upper surface of an embodiment of a mattress assembly, including a primary cushion, rails (e.g., side rails, end rails, etc.) surrounding an outer periphery of the primary cushion, and strips of scrim fabric positioned over an interface or seam between the primary cushion and one or more of the side rails of the mattress assembly.
Figure 2:
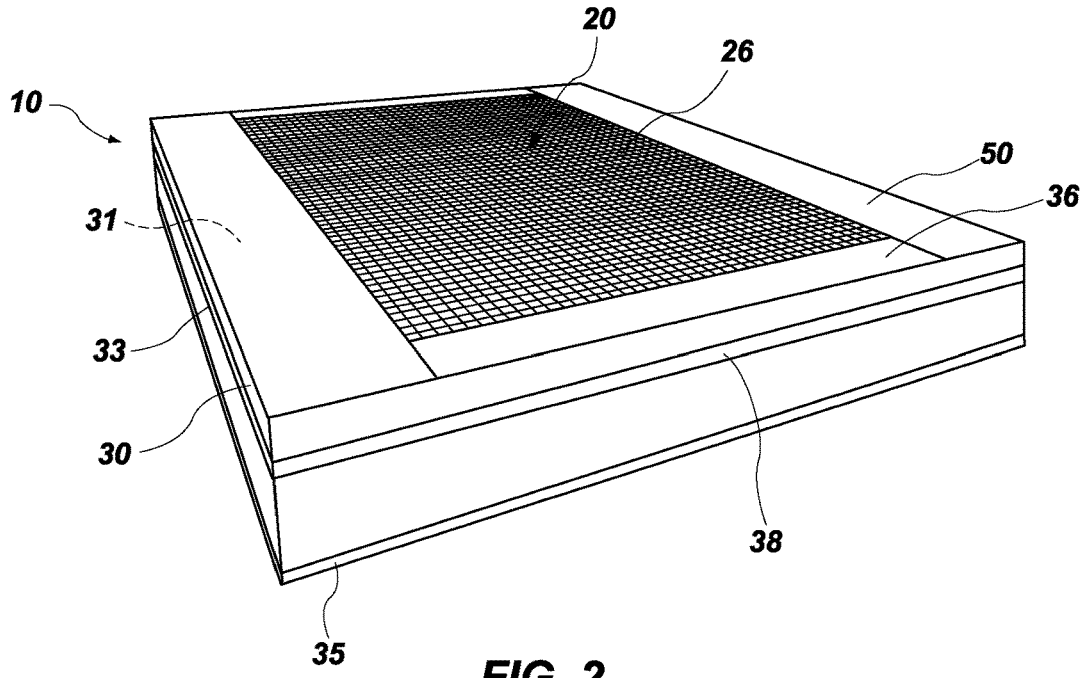
FIG. 2 is a perspective view of a mattress assembly, again showing an upper surface of a primary cushion and rails of the mattress assembly, as well as strips of scrim fabric covering side rails of the mattress assembly and adjacent side portions of the primary cushion.

With reference to FIGS. 1 and 2, an embodiment of a mattress assembly 10 that includes a primary cushion 20, side rails 30, optional end rails 35, and strips of scrim fabric 50 is depicted. The side rails 30 are positioned adjacent to side edges 22 and 23 of the primary cushion 20. The end rails 35, if any, are positioned adjacent to end edges 24 and 25 of the primary cushion 20. For the sake of simplicity, each side rail 30 and each end rail 35 may also be referred to as a "rail" (i.e., as a "rail 30," a "rail 35," or a "rail 30, 35") Each strip of scrim fabric 50 is positioned over an interface or seam 42, 43 between a side edge 22, 23 of the primary cushion 20 and a rail 30 positioned against the side edge 22, 23. Thus, each strip of scrim fabric 50 overlaps a portion of the primary cushion 20 and at least a portion of the corresponding side rail 30. In embodiments where the mattress assembly 10 includes end rails 35, each strip of scrim fabric 50 may also overlap a portion of one or both end rails 35.

The primary cushion 20, in addition to including side edges 22 and 23 and end edges 24 and 25 (e.g., end edge 24 may comprise a first end edge or head edge; end edge 25 may comprise a second end edge or foot edge; etc.), includes an upper surface 26 and a lower surface (not shown) opposite from the upper surface 26. Each side rail 30 and end rail 35 may likewise include an upper surface 31, 36, respectively, and a lower surface 33, 38, respectively, opposite from the upper surface 31, 36. While FIGS. 1 and 2 show the scrim strips 50 as being positioned over and secured to the upper surfaces 26 and 31 of the primary cushion 20 and side rails 30, respectively, embodiments of mattress assemblies with scrim strips 50 overlapping and secured to lower surfaces 28 and 33 of the primary cushion 20 and side rails 30, respectively, are also within the scope of this disclosure.

The primary cushion 20 may comprise a plurality of resiliently compressible walls 102 defining an array of resiliently buckling columns 104 and a void 106 within each resiliently buckling column 104. Embodiments of such a primary cushion 20 are disclosed by U.S. Pat. Nos. 7,060,213, 7,076,822, and 8,919,750, the entire disclosures of which are hereby incorporated herein. The resiliently compressible walls 102, buckling columns 104, and voids 106 may extend completely through a thickness of the primary cushion 20, substantially through a thickness of the primary cushion 20 (e.g., a film of the material from which the primary cushion 20 is formed may extend over a major surface (e.g., the top surface 26, the bottom surface 28) of the primary cushion 20, etc.), or partially through a thickness of the primary cushion 20 (e.g., from one major surface of the primary cushion 20 partially into the thickness of the primary cushion 20, etc.).

The resiliently compressible walls 102 of the primary cushion 20 may be formed from any suitable material, including, but not limited to, an elastomeric material. The elastomeric material may comprise a gel-like material, or an elastomeric gels or gel elastomer. Examples of elastomeric materials that comprise gel-like materials include, but are not limited to, plasticizer extended block copolymers, diblock copolymers and triblock copolymers. U.S. Pat. Nos. 6,413,458, 6,797,765 and 7,964,664, the entire disclosures of which are hereby incorporated herein, disclose various embodiments of plasticizer extended A-B-A triblock copolymers that may be used to form the primary cushion.

A scrim fabric (not shown) may be secured to the bottom surface (not shown) of the primary cushion 20. The scrim fabric may comprise the same type of fabric as or a type of fabric similar to the fabric from which the strips of scrim fabric 50 are formed, a fabric similar to the fabric from which the strips of scrim fabric 50 are formed, or any other suitable fabric. The scrim fabric may be secured to the bottom surface of the primary cushion 20 by an elastomeric material of the primary cushion 20 impregnating the scrim fabric, with an adhesive material, or in any other suitable manner. In embodiments where the mattress assembly 10 includes a cushioning element (e.g., a layer of foam, etc.) beneath the primary cushion 20 (not shown), the scrim fabric or elastomeric material that has seeped therethrough may be positioned against the intermediate cushioning element. In some embodiments, the scrim fabric may be secured to the intermediate cushioning element (e.g., with an adhesive material, etc.). In some embodiments, the primary cushion 20 may be provided over coils (not shown; see, e.g., U.S. Pat. No. 11,317,733, issued on May 3, 2022, the entire disclosure of which is hereby incorporated herein), over one or more pressurizable chambers (not shown; see e.g., U.S. Patent Application Publication US 2021/0251393 A1, published on Aug. 19, 2021 ("the '393 Publication"), the entire disclosure of which is hereby incorporated herein; U.S. Patent Application Publication US 2022/0273113 A1, published on Sep. 1, 2022, the entire disclosure of which is hereby incorporated herein), or over a combination of coils and one or more pressurizable chambers (see, e.g., the '393 Publication).

Each rail 30, 35 may include an outer edge 300, 350 and an inner edge 30*i*, 35*i*, as well as ends 30*e*, 35*c*. The inner edge 30*i*, 35*i* of each rail 30, 35 may be positioned adjacent to a side edge 22, 23 or an end edge 24, 25 of the primary cushion 20. The upper surface 31, 36 of each side rail 30, 35 may be substantially flush with or substantially coplanar with the upper surface 26 of the primary cushion 20. Each rail 30, 35 may comprise a compressible, resilient foam material. A stiffness or firmness of the material that forms the rail 30, 35 may exceed a stiffness or firmness of the material that forms the primary cushion 20. In some embodiments, the rails 30, 35 may prevent the side edges 22, 23 and end edges 24, 25 of the primary cushion 20 from bulging outwardly.

Each strip of scrim fabric 50 may comprise a fabric that may receive (e.g., engage, be impregnated with, etc.) an adhesive material (e.g., a glue), a material that forms the primary cushion 20, or the like. In some embodiments, the fabric of the strip of scrim fabric 50 may comprise cotton, such as a blend of cotton with a synthetic material (e.g., a cotton spandex blend, etc.). The fabric of the strip of scrim fabric 50 may be woven or non-woven. In a specific embodiment, each strip of scrim fabric 50 may comprise a 90% cotton/10% spandex blend with a weight of 100 GSM (grams per square meter).

Each strip of scrim fabric 50 may include an outer side edge 500, an inner side edge 50*i*, and ends 50*e*. A strip of scrim fabric 50 may be positioned over the interface, or seam 42, 43, between each side rail 30 and a side portion 26*s* of the upper surface 26 of the primary cushion 20 adjacent to the side rail 30, as well as over at least portions of the upper surface 31 of the side rail 30 and the side portion 26*s* of the upper surface 26 of the primary cushion 20. The outer side edge 500 of the strip of scrim fabric 50 may be positioned over or adjacent to the outer edge 300 of the side rail 30. The inner side edge 50*i* of the strip of scrim fabric 50 may be positioned over the side portion 26*s* of the upper surface 26 of the primary cushion 20.

Figure 3:
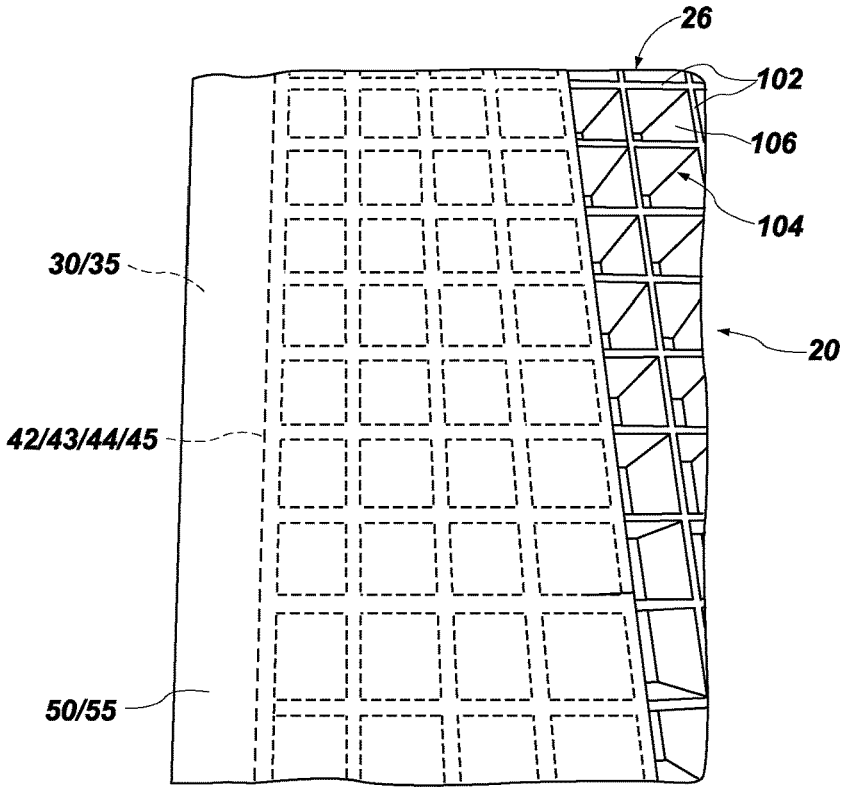
FIG. 3 is a partial, close-up view of a strip of scrim fabric overlying an interface or seam between a rail of a mattress assembly and a peripheral portion of a primary cushion of the mattress assembly.

In some embodiments, the inner side edge 50*i* of the strip of scrim fabric 50 is located about 0.75 inch (about 2 cm) to about 6 inches (about 15 cm) interior to the side edge 22, 23 of the primary cushion 20. FIG. 3 shows an embodiment in which the inner side edge 50*i* of the strip of scrim fabric 50 overlaps the side portion 26*s* of the upper surface 26 of the primary cushion 20 by about four buckling columns 104, or by about 4 inches (about 10 cm) to about 6 inches (about 15 cm). It will be appreciated that each strip of scrim fabric 50 may extend a lesser distance or a greater distance over a side portion 26*s* of the upper surface 26 of the primary cushion 20 or lesser distance over each side rail 30. The distance each strip of scrim fabric 50 extends over the side portion 26*s* of the upper surface 26 of the primary cushion 20 may depend on the width of the upper surface 26 of the primary cushion 20. A central portion 26*c* of the upper surface 26 of the primary cushion 20 may remain exposed beyond the strip of scrim fabric 50.

With continued reference to FIGS. 1 and 2, in embodiments where the mattress assembly 10 also includes one or more end rails 35, at least part of an end portion 50*e* of each strip of scrim fabric 50 that extends over a side rail 30 may be positioned over a portion of the upper surface 36 of an end rail 35. As illustrated by FIG. 1, each strip of scrim fabric 50 that extends over the upper surface 31 of a side rail 30 and an adjacent side portion 26*s* of the upper surface 26 of the primary cushion 20 may also extend over end rails 35 positioned adjacent to both end edges 24 and 25 of the primary cushion 20.

Figure 4:
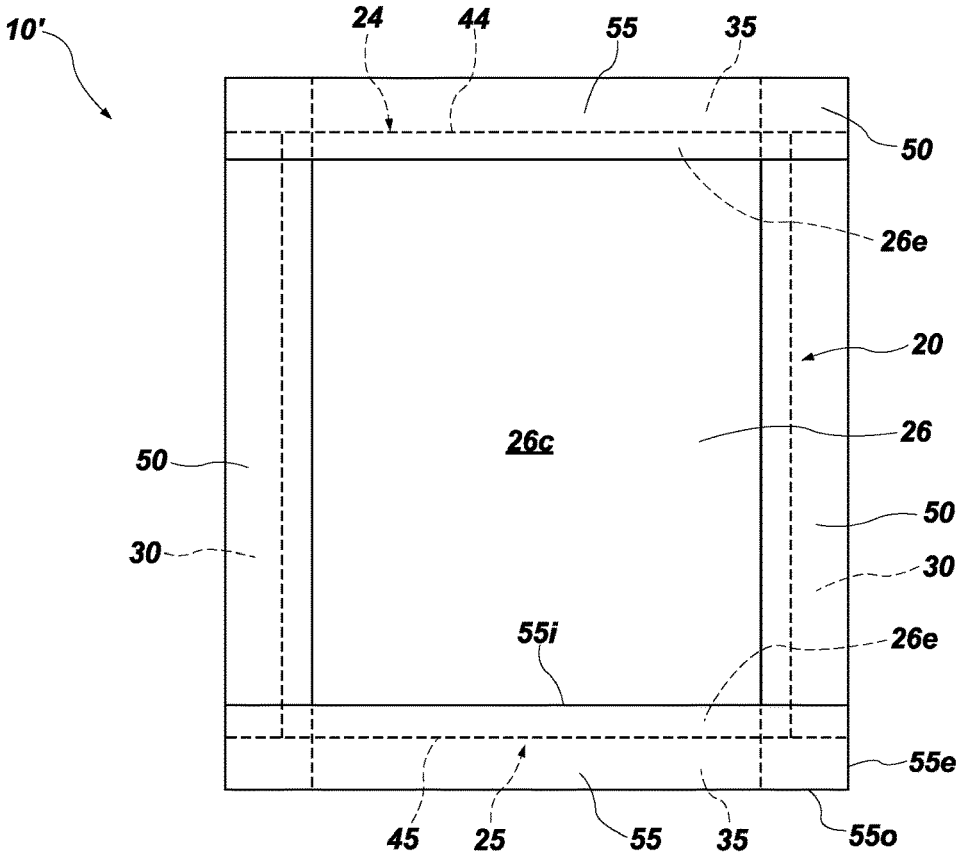
FIG. 4 is a schematic representation of an upper surface of another embodiment of a mattress assembly, including a primary cushion, rails (e.g., side rails, end rails, etc.) surrounding an outer periphery of the primary cushion, and strips of scrim fabric positioned over interfaces or seams between sides of the primary cushion and one or more of the side rails of the mattress assembly and over interfaces or seams between ends of the primary cushion and one or more end rails of the primary cushion.

Turning now to FIG. 4, an embodiment of a mattress assembly 10' that includes a primary cushion 20, side rails 30, end rails 35, and strips of scrim fabric 50. In addition, the mattress assembly 10' of FIG. 4 includes strips of scrim fabric 55.

Each strip of scrim fabric 55 may comprise a fabric that may receive (e.g., engage, be impregnated with, etc.) an adhesive material (e.g., a glue), a material that forms the primary cushion 20, or the like. In some embodiments, the fabric of the strip of scrim fabric 55 may comprise cotton, such as a blend of cotton with a synthetic material (e.g., a cotton spandex blend, etc.). The fabric of the strip of scrim fabric 55 may be woven or non-woven. In a specific embodiment, each strip of scrim fabric 55 may comprise a 90% cotton/10% spandex blend with a weight of 100 GSM (grams per square meter).

Each strip of scrim fabric 55 may include an outer side edge 550, an inner side edge 55*i*, and ends 55*e*. A strip of scrim fabric 55 may be positioned over the interface, or seam 44, 45, between each end rail 35 and an end portion 26*e* of the upper surface 26 of the primary cushion 20 adjacent to the end rail 35, as well as over at least portions of the upper surface 36 of the end rail 35 and the end portion 26*e* of the upper surface 26 of the primary cushion 20. The outer side edge 550 of the strip of scrim fabric 55 may be positioned over or adjacent to the outer edge 350 of the end rail 35. The inner side edge 55*i* of the strip of scrim fabric 55 may be positioned over the end portion 26*e* of the upper surface 26 of the primary cushion 20.

In some embodiments, the inner side edge 55*i* of the strip of scrim fabric 55 is located about 0.75 inch (about 2 cm) to about 6 inches (about 15 cm) interior to the end edge 24, 25 of the primary cushion 20. More specifically, the inner side edge 55*i* of the strip of scrim fabric 55 may overlap the end portion 26*e* of the upper surface 26 of the primary cushion 20 by about four buckling columns 104, or by about 4 inches (about 10 cm) to about 6 inches (about 15 cm) (see FIG. 3). It will be appreciated that each strip of scrim fabric 55 may extend a lesser distance or a greater distance over an end portion 26*e* of the upper surface 26 of the primary cushion 20 or lesser distance over each end rail 35. The distance each strip of scrim fabric 55 extends over the end portion 26*e* of the upper surface 26 of the primary cushion 20 may depend on the length of the upper surface 26 of the primary cushion 20. A central portion 26*c* of the upper surface 26 of the primary cushion 20 may remain exposed beyond the strip of scrim fabric 55.

In other embodiments, a single sheet of scrim fabric that extends across and beyond an entire width and/or length of the upper surface 26 of the primary cushion 20 may be used in place of two or more strips of scrim fabric 50, 55.

With continued reference to FIG. 4, at least part of an end portion 55*e* of each strip of scrim fabric 55 that extends over an end rail 35 may be positioned over a portion of the upper surface 31 of a side rail 30. As illustrated by FIG. 4, each strip of scrim fabric 55 that extends over the upper surface 36 of an end rail 35 and an adjacent end portion 26*e* of the upper surface 26 of the primary cushion 20 may also extend over side rails 30 positioned adjacent to both side edges 22 and 23 of the primary cushion 20 and/or over an end portion 50*e* of a strip of scrim fabric 50 over a side rail 30 and an adjacent side portion 26*s* of upper surface 26 of the primary cushion 20.

Referring generally to FIGS. 1-4, each strip of scrim fabric 50, 55 may be secured directly or indirectly (e.g., through an overlapping portion of another strip of scrim fabric 50, 55, etc.) to the upper surface 31, 36 of the rail 30, 35, respectively, the strip of scrim fabric 50, 55 overlies and to a portion 26*s*, 26*e* of the upper surface 26 of the primary cushion 20 it overlies. Without limitation, each strip of scrim fabric 50, 55 may be glued or otherwise adhesively secured to the upper surface 31, 36 of the rail 30, 35 it overlies. Each strip of scrim fabric 50, 55 may be directly or indirectly (e.g., through an overlapping portion of another strip of scrim fabric 50, 55, etc.) to the portion 26*s*, 26*e* of the upper surface 26 of the primary cushion 20 it overlies with an adhesive material, such as a glue, or by being bonded (e.g., melt bonded, in which the elastomeric material of the primary cushion 20 may impregnate the strip of scrim fabric 50, 55; etc.) by a material of the upper surface 26 of the primary cushion 20 that engages (e.g., has impregnated, etc.) the strip of scrim fabric 50, 55.

A mattress assembly 10, 10' of this disclosure may be incorporated into a mattress, which may be used in an adjustable bed. Each strip of scrim fabric 50, 55 of such a mattress assembly 10, 10' may keep the top surfaces 31, 36 of the rails 30, 35, respectively, substantially flush with the top surface 26 of the primary cushion 20 of the mattress assembly 10, 10' while the mattress of which the mattress assembly 10, 10' is a part is adjusted (e.g., its contour is changed, etc.).

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A mattress assembly, comprising:

a primary cushion comprising an elastomeric gel material defining a plurality of interconnected walls, the primary cushion including an upper surface, a lower surface opposite from the upper surface, and a periphery including a first end edge, a second end edge, and side edges;

a side rail adjacent to each side edge of the side edges of the primary cushion, each side rail including an upper surface that is substantially flush with the upper surface of the primary cushion; and a strip of scrim fabric positioned over the upper surface of each side rail and over a side portion of the upper surface of the primary cushion adjacent to each side rail, each strip of scrim fabric (i) secured to the side portion of the upper surface of the primary cushion via the elastomeric gel material being melt bonded within the scrim fabric and (ii) secured to the upper surface of each side rail via adhesion between the strip of scrim fabric and the upper surface.

2. The mattress assembly of claim 1, wherein an outer side edge of each strip of scrim fabric is positioned over or adjacent to an outer edge of each side rail and an inner side edge of each strip of scrim fabric is positioned over the side portion of the upper surface of the primary cushion.

3. The mattress assembly of claim 2, wherein each inner side edge of each strip of scrim fabric is located about 2 inches to about 6 inches interior to the side edge of the primary cushion.

4. The mattress assembly of claim 1, wherein each strip of scrim fabric does not extend over a central portion of the primary cushion.

5. The mattress assembly of claim 1, wherein each strip of scrim fabric is adhered to each side rail.

6. The mattress assembly of claim 1, wherein a material of the primary cushion impregnates each strip of scrim fabric.

7. The mattress assembly of claim 1, further comprising:

a first end rail adjacent to the first end edge of the primary cushion, a first end of each strip of scrim fabric extending over and secured to the first end rail.

8. The mattress assembly of claim 7, further comprising:

a second end rail adjacent to the second end edge of the primary cushion, a second end of each strip of scrim fabric extending over and secured to the second end rail.

9. A method for assembling a mattress, comprising:

positioning a strip of scrim fabric over an interface between a side edge of a primary cushion and a side rail adjacent to the side edge of the primary cushion, an upper surface of the side rail being substantially flush with an upper surface of the primary cushion, wherein the primary cushion comprises an elastomeric gel material defining a plurality of interconnected walls;

securing the strip of scrim fabric to the upper surface of the side rail via adhesion between the strip of scrim fabric and the upper surface of the side rail; and securing the strip of scrim fabric to the upper surface of the primary cushion via the elastomeric gel material being melt bonded to the strip of scrim fabric.

10. The method of claim 9, wherein positioning the strip of scrim fabric comprises positioning an outer side edge of the strip of scrim fabric over or adjacent to an outer edge of the side rail and positioning an inner side edge of the strip of scrim fabric over the side edge of the primary cushion.

11. The method of claim 10, wherein positioning the strip of scrim fabric comprises positioning the inner side edge of the strip of scrim fabric about 2 inches to about 6 inches interior to the side edge of the primary cushion.

12. The method of claim 9, wherein positioning the strip of scrim fabric comprises leaving a central portion of the primary cushion exposed beyond the strip of scrim fabric.

13. The method of claim 9, wherein melt bonding comprises heating the upper surface of the primary cushion through the scrim fabric to a temperature that causes a material at the upper surface of the primary cushion to melt and wick into the strip of scrim fabric.

14. The method of claim 9, wherein securing the strip of scrim fabric to the upper surface of the side rail and securing the strip of scrim fabric to the upper surface of the primary cushion occur concurrently.

15. The method of claim 9, wherein positioning the strip of scrim fabric includes positioning at least one end portion of the strip of scrim fabric at over a portion of at least one end rail adjacent to an end of the primary cushion and an end of the side rail, and further comprising:

securing the strip of scrim fabric to the portion of the at least one end rail.

16. The method of claim 15, wherein:

positioning the strip of scrim fabric includes positioning end portions of the strip of scrim fabric over portions of end rails adjacent to each end of the primary cushion; and securing the strip of scrim fabric to the at least one end rail comprises securing the portions of the end rails.

* * * * *